US007794217B2

(12) United States Patent
Williamson et al.

(10) Patent No.: US 7,794,217 B2
(45) Date of Patent: Sep. 14, 2010

(54) VARIABLE CAPACITY VANE PUMP WITH DUAL CONTROL CHAMBERS

(75) Inventors: Matthew Williamson, Richmond Hill (CA); David R. Shulver, Richmond Hill (CA)

(73) Assignee: Magna Powertrain Inc., Concord, Ontario ( * ) Notice: Subject to any disclaimer, the term of this patent is extended or adjusted under 35 U.S.C. 154(b) by 560 days.

(21) Appl. No.: 11/720,787

(22) PCT Filed: Dec. 21, 2005

(86) PCT No.: PCT/CA2005/001946

§ 371 (c)(1),
(2), (4) Date: Jun. 4, 2007

(87) PCT Pub. No.: WO2006/066405

PCT Pub. Date: Jun. 29, 2006

(65) Prior Publication Data

US 2009/0022612 A1 Jan. 22, 2009

Related U.S. Application Data

(60) Provisional application No. 60/639,185, filed on Dec. 22, 2004.

(51) Int. Cl.
*F04C 2/00* (2006.01)
*F04C 14/18* (2006.01)

(52) U.S. Cl. ..... 418/26; 418/27; 418/30; 417/220

(58) Field of Classification Search ..... 418/24–27, 418/30; 417/220, 213
See application file for complete search history.

(56) References Cited

U.S. PATENT DOCUMENTS

| | | | | |
|---|---|---|---|---|
| 4,437,819 | A * | 3/1984 | Merz | 418/26 |
| 4,531,893 | A | 7/1985 | Okoh et al. | |
| 5,090,881 | A | 2/1992 | Suzuki et al. | |
| 5,562,432 | A | 10/1996 | Semba et al. | |
| 6,155,797 | A | 12/2000 | Kazuyoshi | |
| 6,352,415 | B1 | 3/2002 | Uchino | |
| 6,530,752 | B2 | 3/2003 | Oba et al. | |
| 6,558,132 | B2 | 5/2003 | Hanggi | |
| 6,688,862 | B2 | 2/2004 | Jeronymo et al. | |

(Continued)

FOREIGN PATENT DOCUMENTS

| | | | | |
|---|---|---|---|---|
| EP | 49838 A1 * | 4/1982 | | 418/26 |

*Primary Examiner*—Theresa Trieu
(74) *Attorney, Agent, or Firm*—Harness, Dickey & Pierce, P.L.C.

(57) ABSTRACT

A variable capacity vane pump includes a pump casing having a pump chamber with an inlet and an outlet port. A pump control ring is moveable within the pump chamber to alter the capacity of the pump. A vane pump rotor is rotatably mounted within the pump control ring and includes a plurality of slidably mounted vanes engaging the inside surface of the pump control ring. First and second control chambers between the pump casing and the pump control ring are operable to receive pressurized fluid to urge the pump control ring to reduce the volumetric capacity of the pump. A return spring biases the pump ring toward a position of maximum volumetric capacity against the force of the first and second control chambers to establish an equilibrium pressure. The supply of pressurized fluid to the second control chamber may be varied to change the equilibrium pressure of the pump.

16 Claims, 5 Drawing Sheets

U.S. PATENT DOCUMENTS 6,763,797 B1 7/2004 Staley
6,790,013 B2 9/2004 Hunter et al.
2002/0114708 A1 8/2002 Hunter et al.
2008/0247894 A1* 10/2008 Lutoslawski et al. ..... 418/27

* cited by examiner

VARIABLE CAPACITY VANE PUMP WITH DUAL CONTROL CHAMBERS

CROSS-REFERENCE TO RELATED APPLICATIONS

This application is the national phase under 35 U.S.C. §371 of PCT International Application No. PCT/CA05/01946 which has an international filing date of Dec. 21, 2005, which designated the United States of America, which application claims the benefit of U.S. Provisional Application No. 60/639,185 filed on Dec. 22, 2004. The entire disclosure of each of the above applications is incorporated herein by reference.

FIELD OF THE INVENTION

The present invention relates to a variable capacity vane pump. More specifically, the present invention relates to a variable capacity vane pump in which at least two different equilibrium pressures can be selected between by supplying working fluid to two or more control chambers adjacent the control ring.

BACKGROUND OF THE INVENTION

Variable capacity vane pumps are well known and can include a capacity adjusting element, in the form of a pump control ring that can be moved to alter the rotor eccentricity of the pump and hence alter the volumetric capacity of the pump. If the pump is supplying a system with a substantially constant orifice size, such as an automobile engine lubrication system, changing the output volume of the pump is equivalent to changing the pressure produced by the pump.

Having the ability to alter the volumetric capacity of the pump to maintain an equilibrium pressure is important in environments such as automotive lubrication pumps, wherein the pump will be operated over a range of operating speeds. In such environments, to maintain an equilibrium pressure it is known to employ a feedback supply of the working fluid (e.g. lubricating oil) from the output of the pump to a control chamber adjacent the pump control Ting, the pressure in the control chamber acting to move the control ring, typically against a biasing force from a return spring, to alter the capacity of the pump.

When the pressure at the output of the pump increases, such as when the operating speed of the pump increases, the increased pressure is applied to the control ring to overcome the bias of the return spring and to move the control ring to reduce the capacity of the pump, thus reducing the output volume and hence the pressure at the output of the pump.

Conversely, as the pressure at the output of the pump drops, such as when the operating speed of the pump decreases, the decreased pressure applied to the control chamber adjacent the control ring allows the bias of the return spring to move the control ring to increase the capacity of the pump, raising the output volume and hence pressure of the pump. In this manner, an equilibrium pressure is obtained at the output of the pump.

The equilibrium pressure is determined by the area of the control ring against which the working fluid in the control chamber acts, the pressure of the working fluid supplied to the chamber and the bias force generated by the return spring.

Conventionally, the equilibrium pressure is selected to be a pressure which is acceptable for the expected operating range of the engine and is thus somewhat of a compromise as, for example, the engine may be able to operate acceptably at lower operating speeds with a lower working fluid pressure than is required at higher engine operating speeds. In order to prevent undue wear or other damage to the engine, the engine designers will select an equilibrium pressure for the pump which meets the worst case (high operating speed) conditions. Thus, at lower speeds, the pump will be operating at a higher capacity than necessary for those speeds, wasting energy pumping the surplus, unnecessary, working fluid.

It is desired to have a variable capacity vane pump which can provide at least two selectable equilibrium pressures in a reasonably compact pump housing. It is also desired to have a variable capacity vane pump wherein reaction forces on the pivot pin for the pump control ring are reduced.

SUMMARY OF THE INVENTION

It is an object of the present invention to provide a novel variable capacity vane pump which obviates or mitigates at least one disadvantage of the prior art.

According to a first aspect of the present invention, there is provided a variable capacity vane pump having a pump control ring which is moveable to alter the capacity of the pump, the pump being operable at least two selected equilibrium pressures, comprising: a pump casing having a pump chamber therein; a vane pump rotor rotatably mounted in the pump chamber; a pump control ring enclosing the vane pump rotor within said pump chamber, the control pump ring being moveable within the pump chamber to alter the capacity of the pump; a first control chamber between the pump casing and the pump control ring, the first control chamber operable to receive pressurized fluid to create a force to move the pump control ring to reduce the volumetric capacity of the pump; a second control chamber between the pump casing and the pump control ring, the second control chamber operable to receive pressurized fluid to create a force to move the pump control ring to reduce the volumetric capacity of the pump; and a return spring acting between pump ring and the casing to bias the pump ring towards a position of maximum volumetric capacity, the return spring acting against the force of the first and second control chambers to establish an equilibrium pressure and wherein the supply of pressurized fluid to the second control chamber can be applied or removed to change the equilibrium pressure of the pump.

According to a second aspect of the present invention, there is provided a variable capacity vane pump comprising: a pump casing having a pump chamber therein; a vane pump rotor rotatably mounted in the pump chamber; a pump control ring enclosing the vane pump rotor within said pump chamber, the control pump ring being moveable about a pivot pin within the pump chamber to alter the capacity of the pump; a control chamber defined between the pump casing, the pump control ring, the pivot pin and a resilient seal between the pump control ring and the pump casing, the control chamber being operable to receive pressurized fluid to create a force to move the pump control ring to reduce the volumetric capacity of the pump; and a return spring acting between pump ring and the casing to bias the pump ring towards a position of maximum volumetric capacity, the return spring acting against the force of the control chamber to establish an equilibrium pressure and wherein the pivot pin and the resilient seal are positioned to reduce the area of the pump control ring within the control chamber such that the resulting force on the pump control ring exerted by pressurized fluid in the control chamber is reduced.

Preferably, the return spring is oriented such that the biasing force it applies to the pump control ring farmer reduces the reaction forces on the pivot pin. Also preferably, the control chamber is positioned, with respect to the pivot pin, such that the resulting force reduces reaction forces on the pivot pin.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
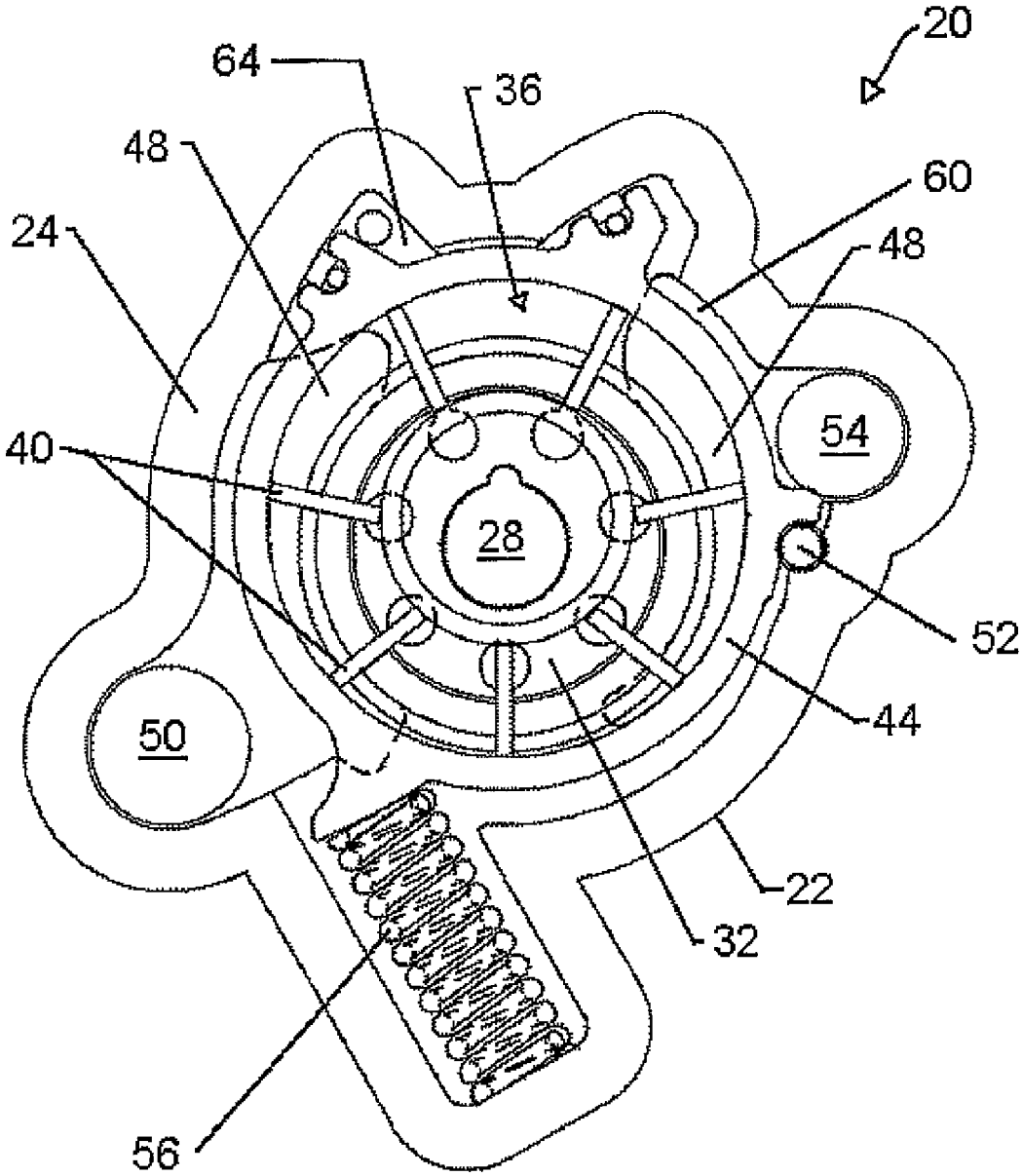
FIG. 1 is a front view of a variable capacity vane pump in accordance with the present invention with the control ring positioned for maximum rotor eccentricity.
Figure 2:
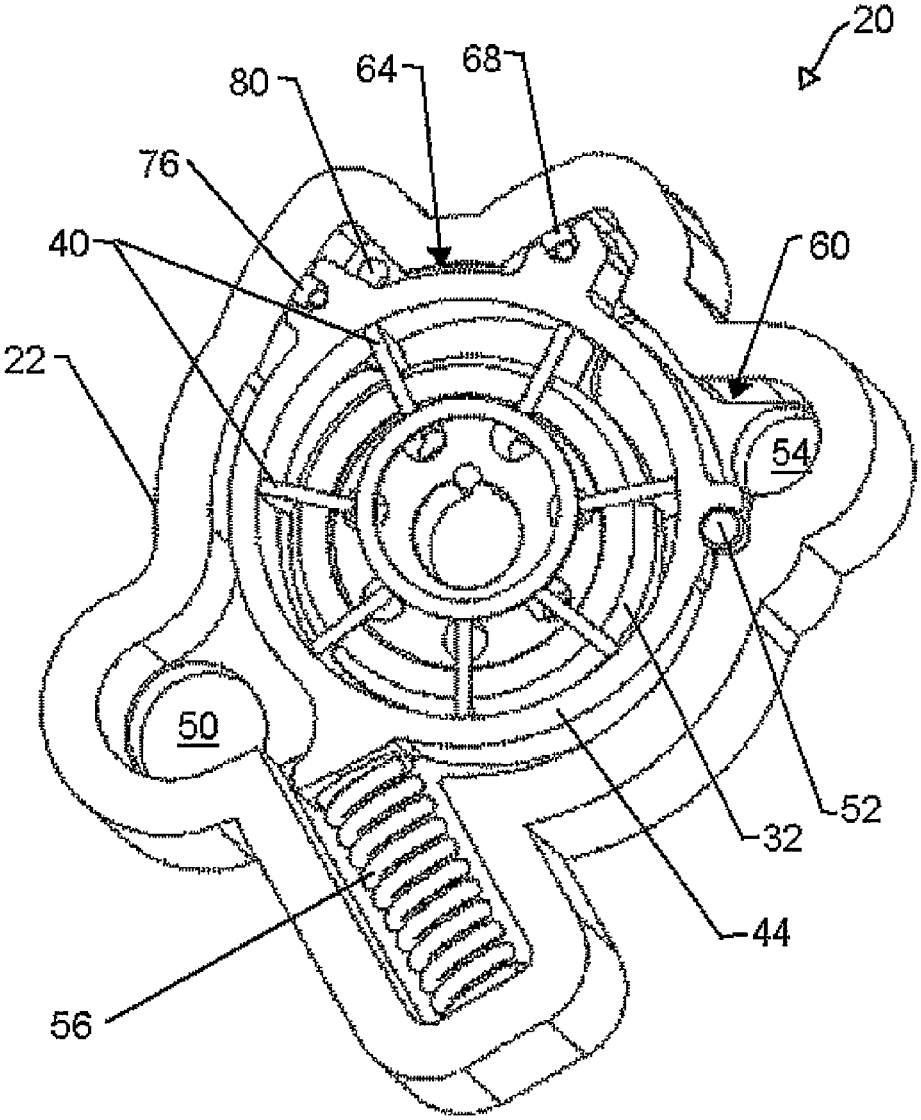
FIG. 2 is a front perspective view of the pump of FIG. 1 with the control ring positioned for maximum rotor eccentricity.
Figure 3:
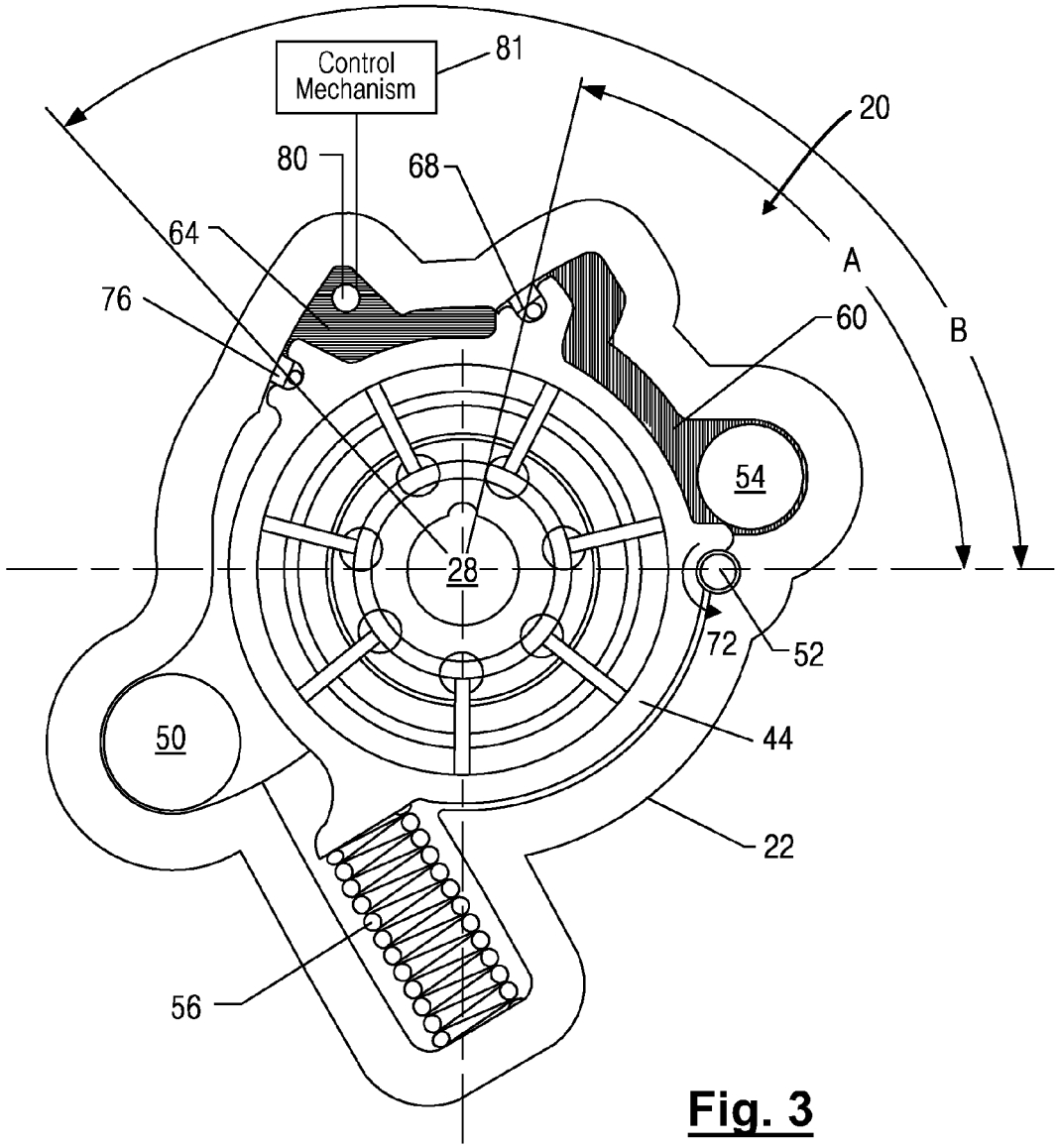
FIG. 3 is the a front view of the pump of FIG. 1 with the control ring position for minimum eccentricity and wherein the areas of the pump control chambers are in hatched line.

A variable capacity vane pump in accordance with an embodiment of the present invention is indicated generally at 20 in FIGS. 1, 2 and 3.

Referring now to FIGS. 1, 2 and 3, pump 20 includes a housing or casing 22 with a front face 24 which is sealed with a pump cover (not shown) and a suitable gasket, to an engine (not shown) or the like for which pump 20 is to supply pressurized working fluid.

Pump 20 includes a drive shaft 28 which is driven by any suitable means, such as the engine or other mechanism to which the pump is to supply working fluid, to operate pump 20. As drive shaft 28 is rotated, a pump rotor 32 located within a pump chamber 36 is turned with drive shaft 28. A series of slidable pump vanes 40 rotate with rotor 32, the outer end of each vane 40 engaging the inner surface of a pump control ring 44, which forms the outer wall of pump chamber 36. Pump chamber 36 is divided into a series of working fluid chambers 48, defined by the inner surface of pump control ring 44, pump rotor 32 and vanes 40. The pump rotor 32 has an axis of rotation that is eccentric from the center of the pump control ring 44.

Pump control ring 44 is mounted within casing 22 via a pivot pin 52 which allows the center of pump control ring 44 to be moved relative to the center of rotor 32. As the center of pump control ring 44 is located eccentrically with respect to the center of pump rotor 32 and each of the interior of pump control ring 44 and pump rotor 32 are circular in shape, the volume of working fluid chambers 48 changes as the chambers 48 rotate around pump chamber 36, with their volume becoming larger at the low pressure side (the left hand side of pump chamber 36 in FIG. 1) of pump 20 and smaller at the high pressure side (the right hand side of pump chamber 36 in FIG. 1) of pump 20. This change in volume of working fluid chambers 48 generates the pumping action of pump 20, drawing working fluid from an inlet port 50 and pressurizing and delivering it to an outlet port 54.

By moving pump control ring 44 about pivot pin 52 the amount of eccentricity, relative to pump rotor 32, can be changed to vary the amount by which the volume of working fluid chambers 48 change from the low pressure side of pump 20 to the high pressure side of pump 20, thus changing the volumetric capacity of the pump. A return spring 56 biases pump control ring 44 to the position, shown in FIGS. 1 and 2, wherein the pump has a maximum eccentricity.

As mentioned above, it is known to provide a control chamber adjacent a pump control ring and a return spring to move the pump ring of a variable capacity vane pump to establish an equilibrium output volume, and its related equilibrium pressure.

However, in accordance with the present invention, pump 20 includes two control chambers 60 and 64, best seen in FIG. 3, to control pump ring 44. Control chamber 60, the rightmost hatched area in FIG. 3, is formed between pump casing 22, pump control ring 44, pivot pin 52 and a resilient seal 68, mounted on pump control ring 44 and abutting casing 22. In the illustrated embodiment, control chamber 60 is in direct fluid communication with pump outlet 54 such that pressurized working fluid from pump 20 which is supplied to pump outlet 54 also fills control chamber 60.

As will be apparent to those of skill in the art, control chamber 60 need not be in direct fluid communication with pump outlet 54 and can instead be supplied from any suitable source of working fluid, such as from an oil gallery in an automotive engine being supplied by pump 20.

Pressurized working fluid in control chamber 60 acts against pump control ring 44 and, when the force on pump control ring 44 resulting from the pressure of the pressurized working is sufficient to overcome the biasing force of return spring 56, pump control ring 44 pivots about pivot pin 52, as indicated by arrow 72 in FIG. 3, to reduce the eccentricity of pump 20. When the pressure of the pressurized working is not sufficient to overcome the biasing force of return spring 56, pump control ring 44 pivots about pivot pin 52, in the direction opposite to that indicated by arrow 72, to increase the eccentricity of pump 20.

Figure 4:
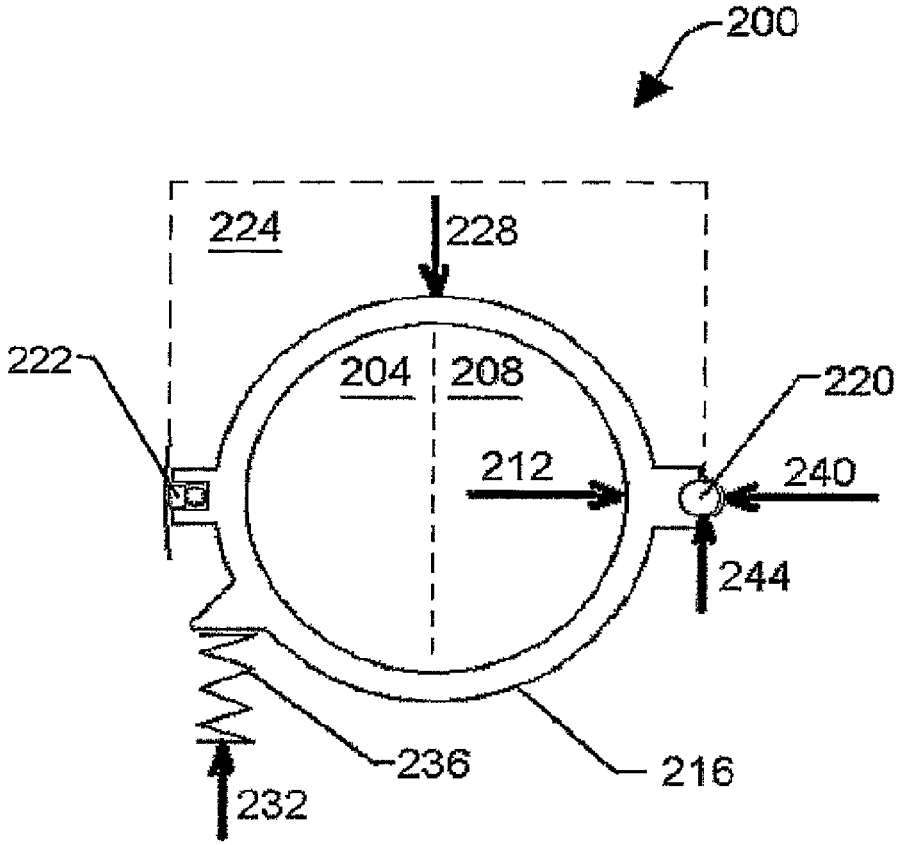
Fig. 4 (prior art)
FIG. 4 shows a schematic representation of a prior art variable capacity vane pump.

Pump 20 further includes a second control chamber 64, the leftmost hatched area in FIG. 3, which is formed between pump casing 22, pump control ring 44, resilient seal 68 and a second resilient seal 76, Resilient seal 76 abuts the wall of pump casing 22 to separate control chamber 64 from pump inlet 50 and resilient seal 68 separates chamber 64 from chamber 60. Control chamber 60 extends circumferentially from pivot pin 52 to resilient seal 68 an amount identified as angle A in FIG. 3. Angle A is less than 90 degrees and substantially 80 degrees. Control chamber 64 extends from resilient seal 68 to second resilient seal 76. An angle B depicts the total number of degrees swept by both control chamber 60 and control chamber 64. Angle B is less than the 180 degree value of the prior art as shown in FIGS. 3 and 4. Angle B is substantially 135 degrees.

Control chamber 64 is supplied with pressurized working fluid through a control port 80. Control port 80 can be supplied with pressurized working fluid from any suitable source, including pump outlet 54 or a working fluid gallery in the engine or other device supplied from pump 20. A control mechanism 81 such as a solenoid operated valve or diverter mechanism is employed to selectively supply working fluid to chamber 64 through control port 80, as discussed below. As was the case with control chamber 60, pressurized working fluid supplied to control chamber 64 from control port 80 acts against pump control ring 44.

As should now be apparent, pump 20 can operate in a conventional manner to achieve an equilibrium pressure as pressurized working fluid supplied to pump outlet 54 also fills control chamber 60. When the pressure of the working fluid is greater than the equilibrium pressure, the force created by the pressure of the supplied working fluid over the portion of pump control ring 44 within chamber 60 will overcome the force of return spring 56 to move pump ring 44 to decrease the volumetric capacity of pump 20. Conversely, when the pressure of the working fluid is less than the equilibrium pressure, the force of return spring 56 will exceed the force created by the pressure of the supplied working fluid over the portion of pump control ring 44 within chamber 60 and return spring 56 will to move pump ring 44 to increase the volumetric capacity of pump 20.

However, unlike with conventional pumps, pump 20 can be operated at a second equilibrium pressure. Specifically, by selectively supplying pressurized working fluid to control chamber 64, via control port 80, a second equilibrium pressure can be selected. For example, a solenoid-operated valve controlled by an engine control system, can supply pressurized working fluid to control chamber 64, via control port 80, such that the force created by the pressurized working fluid on the relevant area of pump control ring 44 within chamber 64 is added to the force created by the pressurized working fluid in control chamber 60, thus moving pump control ring 44 further than would otherwise be the case, to establish a new, lower, equilibrium pressure for pump 20.

As an example, at low operating speeds of pump 20, pressurized working fluid can be provided to both chambers 60 and 64 and pump ring 44 will be moved to a position wherein the capacity of the pump produces a first, lower, equilibrium pressure which is acceptable at low operating speeds.

When pump 20 is driven at higher speeds, the control mechanism can operate to remove the supply of pressurized working fluid to control chamber 64, thus moving pump ring 44, via return spring 56, to establish a second equilibrium pressure for pump 20, which second equilibrium pressure is higher than the first equilibrium pressure.

While in the illustrated embodiment chamber 60 is in fluid communication with pump outlet 54, it will be apparent to those of skill in the art that it is a simple matter, if desired, to alter the design of control chamber 60 such that it is supplied with pressurized working fluid from a control port, similar to control port 80, rather than from pump outlet 54. In such a case, a control mechanism (not shown) such as a solenoid operated valve or a diverter mechanism can be employed to selectively supply working fluid to chamber 60 through the control port. As the area of control ring 44 within each of control chambers 60 and 64 differs, by selectively applying pressurized working fluid to control chamber 60, to control chamber 64 or to both of control chambers 60 and 64 three different equilibrium pressures can be established, as desired.

As will also be apparent to those of skill in the art, should additional equilibrium pressures be desired, pump casing 22 and pump control ring 44 can be fabricated to form one or more additional control chambers, as necessary.

Pump 20 offers a further advantage over conventional vane pumps such as pump 200 shown in FIG. 4. In conventional vane pumps such as pump 200, the low pressure fluid 204 in the pump chamber exerts a force on pump ring 216 as does the high pressure fluid 208 in the pump chamber. These forces result in a significant net force 212 on the pump control ring 216 and this force is largely carried by pivot pin 220 which is located at the point where force 212 acts.

Further, the high pressure fluid within the outlet port 224 (indicated in dashed line), acting over the area of pump ring 216 between pivot pin 220 and resilient seal 222, also results in a significant force 228 on pump control ring 216. While force 228 is somewhat offset by the force 232 of return spring 236, the net of forces 228 less force 232 can still be significant and this net force is also largely carried by pivot pin 220.

Thus pivot pin 220 carries large reaction forces 240 and 244, to counter net forces 212 and 228 respectively, and these forces can result in undesirable wear of pivot pin 220 over time and/or "stiction" of pump control ring 216, wherein it does not pivot smoothly about pivot pin 220, making fine control of pump 200 more difficult to achieve.

Figure 5:
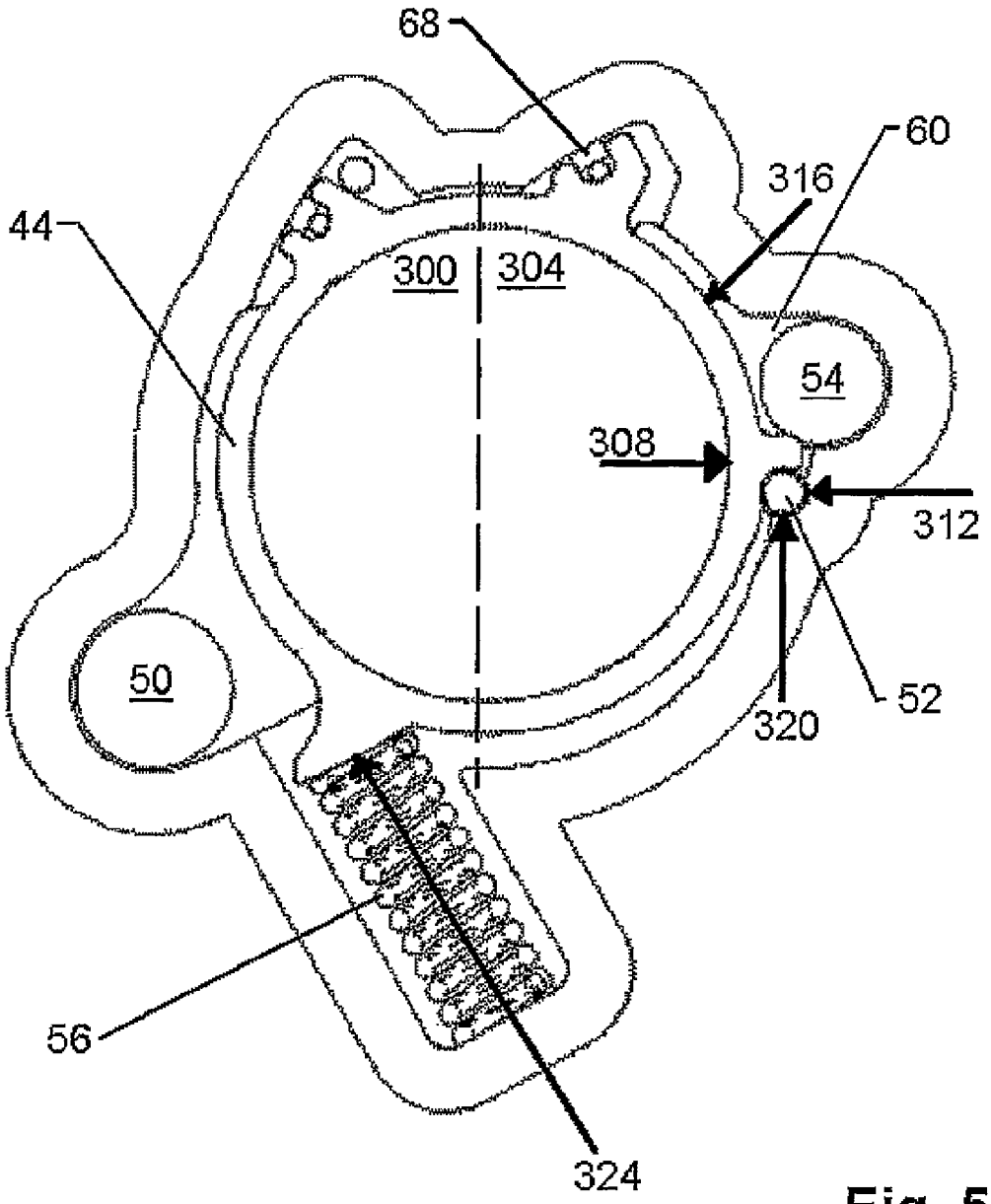
FIG. 5 shows a front view of the pump of FIG. 1 wherein the rotor and vanes have been removed to illustrate the forces within the pump.

As shown in FIG. 5, the low pressure side 300 and high pressure side 304 of pump 20 result in a net force 308 which is applied to pump control ring 44 almost directly upon pivot pin 52 and a corresponding reaction force, shown as a horizontal (with respect to the orientation shown in the Figure) force 312, is produced on pivot pin 52. Unlike conventional variable capacity vane pumps such as pump 200, in pump 20 resilient seal 68 is located relatively closely to pivot pin 52 to reduce the area of pump control ring 44 upon which the pressurized working fluid in control chamber 60 acts and thus to significantly reduce the magnitude of the force 316 produced on pump control ring 44.

Further, control chamber 60 is positioned such that force 316 includes a horizontal component, which acts to oppose force 308 and thus reduce reaction force 312 on pivot pin 52. The vertical (with respect to the orientation shown in the Figure) component of force 316 does result in a vertical reaction force 320 on pivot pin 52 but, as mentioned above, force 316 is of less magnitude than would be the case with conventional pumps and the vertical reaction force 320 is also reduced by a vertical component of the biasing force 324 produced by return spring 56

Thus, the unique positioning of control chamber 60 and return spring 56, with respect to pivot pin 52, results in reduced reaction forces on pivot pin 52 and can improve the operating lifetime of pump 20 and can reduce "stiction" of pump control ring 44 to allow smoother control of pump 20. As will be apparent to those of skill in the art, this unique positioning is not limited to use in variable capacity vane pumps with two or more equilibrium pressures and can be employed with variable capacity vane pumps with single equilibrium pressures.

The above-described embodiments of the invention are intended to be examples of the present invention and alterations and modifications may be effected thereto, by those of skill in the art, without departing from the scope of the invention which is defined solely by the claims appended hereto.

We claim:

1. A variable capacity vane pump having a pump control ring which is moveable to alter the capacity of the pump, the pump being operable at least two selected equilibrium pressures, comprising:

a pump casing having a pump chamber therein, said pump chamber having an inlet port and an outlet port;

a pump control ring moveable within the pump chamber to alter the capacity of the pump;

a vane pump rotor rotatably mounted within the pump control ring, said vane pump rotor having a plurality of slidably mounted vanes engaging an inside surface of said pump control ring, the vane pump rotor having an axis of rotation eccentric from a centre of said pump control ring, the vane pump rotor rotates to pressurize fluid as the fluid moves from the inlet port to the outlet port;

a first control chamber between the pump casing and the pump control ring, the first control chamber operable to receive pressurized fluid to create a force to move the pump control ring to reduce the volumetric capacity of the pump;

a second control chamber between the pump casing and the pump control ring, the second control chamber selectively operable to receive pressurized fluid to create a force to move the pump control ring to reduce the volumetric capacity of the pump; and a return spring acting between pump ring and the casing to bias the pump ring towards a position of maximum volumetric capacity, the return spring acting against the force of the first and second control chambers to establish an equilibrium pressure and wherein the supply of pressurized fluid to the second control chamber is varied to change the equilibrium pressure of the pump.

2. The variable capacity pump of claim 1 wherein pressurized fluid is supplied to the first control chamber when the pump is operating and pressurized fluid is supplied to a second control chamber only in response to a signal from a control system.

3. The variable capacity pump of claim 1 wherein the second control chamber is supplied with pressurized fluid from a control port.

4. The variable capacity pump of claim 1 wherein the first control chamber is in fluid communication with the outlet port and receives the pressurized fluid therefrom.

5. The variable capacity pump of claim 1 wherein the second chamber is formed by the pump casing, the pump control ring and first and second resilient seals acting between the pump control ring and the pump casing.

6. The variable capacity pump of claim 1 wherein a supply of pressurized fluid is applied to either or both of the first and second control chambers to select from three equilibrium pressures for the pump.

7. The variable capacity pump of claim 1 wherein the first control chamber circumferentially extends less than 90 degrees from a pivot point of the pump control ring.

8. A variable capacity vane pump comprising:

a pump casing having a pump chamber therein;

a vane pump rotor rotatably mounted in the pump chamber;

a plurality of vanes slidably mounted on said vane pump rotor;

a pump control ring enclosing the vane pump rotor within said pump chamber, the vane pump rotor having an axis of rotation eccentric from a centre of said pump control ring, the pump control ring being moveable about a pivot pin within the pump chamber to alter the capacity of the pump;

a first control chamber defined between the pump casing, the pump control ring, the pivot pin and a resilient seal between the pump control ring and the pump casing, the first control chamber being operable to receive pressurized fluid to create a force to move the pump control ring to reduce the volumetric capacity of the pump;

a second control chamber between the pump casing and the pump control ring, the second control chamber being defined by the resilient seal and another resilient seal acting between the pump casing and the pump control ring; and a return spring acting between the pump control ring and the casing to bias the pump control ring towards a position of maximum volumetric capacity, the return spring acting against the force of the first control chamber to establish an equilibrium pressure and wherein the pivot pin and the resilient seal are positioned relative to the pump control ring center to define an included angle less than 90 degrees such that a resulting force on the pump control ring exerted by pressurized fluid in the first control chamber is reduced.

9. The variable capacity vane pump according to claim 8 wherein the return spring is oriented such that a biasing force it applies to the pump control ring further reduces the reaction forces on the pivot pin.

10. The variable capacity vane pump according to claim 8 wherein the first control chamber is positioned, with respect to the pivot pin, such that the resulting force reduces reaction forces on the pivot pin.

11. The variable capacity vane pump according to claim 8 wherein the first control chamber and the second control chamber circumferentially extend from the pivot pin equal to or less than 135 degrees.

12. The variable capacity vane pump according to claim 8 wherein the first control chamber and the second control chamber circumferentially extend from the pivot pin substantially less than 180 degrees.

13. A variable capacity vane pump comprising:

a pump casing including a pump chamber;

a pump control ring moveable within the pump chamber to vary the capacity of the pump;

a vane pump rotor positioned within the pump control ring and being rotatable about an axis offset from a center of the pump control ring;

vanes being driven by the rotor and engaging an inside surface of the pump control ring;

a first control chamber between the pump casing and a first portion of the pump control ring, the first control chamber operable to receive pressurized fluid to create a force to move the pump control ring to reduce the volumetric capacity of the pump;

a second control chamber between the pump casing and a second portion of the pump control ring, the second control chamber selectively operable to receive pressurized fluid to create a force to move the pump control ring to reduce the volumetric capacity of the pump, the first and second portions of the pump control ring being separated by a moveable resilient seal; and a return spring biasing the pump ring toward a position of maximum volumetric capacity, the return spring acting against the force of the first and second control chambers to establish an equilibrium pressure.

14. The variable capacity vane pump according to claim 13 wherein the first portion of the pump control ring circumferentially extends from the pivot pin substantially 80 degrees.

15. The variable capacity vane pump according to claim 14 wherein the second portion of the pump control ring circumferentially extends from the resilient seal to another resilient seal substantially 55 degrees.

16. The variable capacity vane pump according to claim 13 wherein the force provided by the first control chamber acts in an opposing direction to a pumping force acting on the pump control ring.

* * * * *